US006956158B2

(12) United States Patent
Booker

(10) Patent No.: US 6,956,158 B2
(45) Date of Patent: Oct. 18, 2005

(54) METHOD OF DETERMINING THE FRET POSITIONS FOR A FINGERBOARD

(76) Inventor: Paul Everard Booker, 29 The Causeway, Steventon, Abingdon, Oxfordshire (GB), OX13 6SE ( * ) Notice: Subject to any disclaimer, the term of this patent is extended or adjusted under 35 U.S.C. 154(b) by 118 days.

(21) Appl. No.: 10/373,717

(22) Filed: Feb. 27, 2003

(65) Prior Publication Data

US 2003/0164081 A1 Sep. 4, 2003

(30) Foreign Application Priority Data

Mar. 1, 2002 (GB) ..... 0204787

(51) Int. Cl.[7] ..... G10D 3/06
(52) U.S. Cl. ..... 84/312; 84/314 R
(58) Field of Search ..... 84/314 R, 312, 84/313, 315, 454, 455

(56) References Cited

U.S. PATENT DOCUMENTS 4,777,858 A * 10/1988 Petschulat et al. ..... 84/314 R
4,852,450 A 8/1989 Novak
5,063,818 A 11/1991 Salazar
5,814,745 A 9/1998 Feiten et al.
6,069,306 A * 5/2000 Isvan et al. ..... 84/267
6,642,442 B2 * 11/2003 Feiten et al. ..... 84/312 R

FOREIGN PATENT DOCUMENTS

JP U 3012510 4/1995

OTHER PUBLICATIONS

US 5,883,316, 3/1999, Kolano (withdrawn)

* cited by examiner

*Primary Examiner*—Kimberly Lockett
(74) *Attorney, Agent, or Firm*—Young & Thompson

(57) ABSTRACT

The position for a fret on a fingerboard for a stringed instrument having non-parallel strings of different scale lengths is determined by interpolating between, or extrapolating from, a fret position (R1, R2 etc.; G1, G2 etc.; Q1, Q2 etc.) on a first fret scale and a corresponding fret position (F1, F2 etc.) on a second fret scale (F–F'; L–L').

17 Claims, 12 Drawing Sheets

METHOD OF DETERMINING THE FRET POSITIONS FOR A FINGERBOARD

FIELD OF THE INVENTION

The present invention relates to a method of determining the fret positions for a fingerboard for a stringed instrument, in particular to determining the fret positions for a fingerboard for which the frets are not perpendicular to the fingerboard. It also relates to a fingerboard, to a jig for making a fingerboard, and to a stringed musical instrument incorporating a fingerboard.

The invention is described below with reference to an acoustic guitar. However, the invention is not limited to a fingerboard for an acoustic guitar, but can be used to determine the fret positions for the fingerboard for any type of stringed musical instrument.

BACKGROUND OF THE INVENTION

The general construction of a stringed musical instrument is illustrated in FIG. 1, which shows an acoustic guitar. The guitar 1 consists of a body 2, to which is attached a neck 3. The guitar is provided with a plurality of strings 4–9; one end of each string is attached the body 2 and the other end of each string is attached to the end of the neck 3 distant from the body 2. Each string makes contact with a "saddle" 10 mounted on the body 2 and with a "nut" 11 mounted on the neck 3, and the maximum vibrating length of each string 4–9 is the length between the point where the string contacts the saddle and the point where the string contacts the "nut". The "scale length" of each string is the maximum length of the string between the saddle 10 and the nut 11 that is free to vibrate. The strings are fastened to the guitar by fasteners 19 disposed beyond the nut and saddle.

The neck is provided with a fingerboard 12 on which is marked a plurality of frets 13. The fingerboard may be integral with the neck, in which case the frets 13 are marked on the upper surface of the neck, or the fingerboard may be a separate overlayer that is attached to the upper surface of the neck. A fret is essentially a line marked on the fingerboard to define a position for the player's finger that produces a desired musical tone. It is a requirement that each fret should allow reduction in the vibrating length of each string which is of the same proportion for each string. For example, on a certain instrument, the $12^{th}$ fret may enable the vibrating length of each string of the instrument to be halved, compared to its maximum vibrating length. The nut may be considered as a zero fret. Tables exist that define the positions of the frets for a string having a standard maximum vibrating length, and the positions of the frets for strings having a different maximum vibrating length are found by scaling. Commonly, as shown in FIG. 1, the nut 11 is perpendicular to the centre-line of the instrument. Commonly, as also shown in FIG. 1, the saddle 10 is not exactly perpendicular to the centre-line of the instrument but is angled slightly to compensate for intonation errors between strings of different thickness. Thus each string has nominally the same scale length, with a small offset to compensate for intonation errors. For such an instrument, the frets 13 are perpendicular to the centre-line of the instrument.

ACKNOWLEDGEMENT OF THE PRIOR ART

U.S. Pat. No. 4,852,450 suggests that the tonal quality of a guitar, or other similar stringed musical instrument, is improved if the strings do not all have the same length. This document proposes that the high frequency ("treble") strings should have a shorter scale length than the low frequency ("bass") strings. It proposes that each string should have a different scale length, with the scale length decreasing as the pitch of the string increases.

In a guitar or other stringed instrument in which the strings have different scale lengths, the prior art technique of making each fret perpendicular to the centre line of the guitar cannot be used. At most one fret will be perpendicular to the centre line of the instrument, and it is quite possible that none of the frets will be perpendicular to the centre line of the guitar. U.S. Pat. No. 4,852,450 proposes that the frets should be defined such that extensions of the frets converge to a single point. This is illustrated schematically in FIG. 1(*b*), which shows a treble string T–T' and a bass string B–B' having a greater length than the treble string. (Other strings are omitted for clarity of explanation.) A plurality of frets are indicated, and it will be seen that extensions of these all converge to the point P defined by the intersection of the extension of the nut and the extension of the saddle.

FIG. 1(*b*) shows a "reference fret scale" F–F', which is marked with frets F1, F2 . . . (the nut end F of the reference fret scale may be considered as a zero fret F0). The positions of the frets on the fingerboard are determined by placing the reference fret scale F–F' parallel to the centre-line M–M' of the fingerboard, at such a distance from the fingerboard that the point F lies on the extension of the nut 11 and the point F' lies on the extension of the saddle. The positions of the frets are then found by joining a fret position on the reference fret scale F–F' to the point P.

The method of U.S. Pat. No. 4,852,450 for defining the positions of the frets can produce acceptable results if the strings of the instrument are parallel to one another. In many cases, however, the strings are not parallel, and the separation of the strings increases from the nut towards the saddle. This is illustrated schematically in FIG. 2, in which the separation between the treble string T–T' and the bass string B–B' is 50 mm at the nut 11, but is 100 mm at the saddle 10 (that is, the strings have a 2:1 taper). It has been found that, where the strings are not parallel, simply marking the fret positions so that their extensions converge to a single point P does not give satisfactory results.

FIG. 2 illustrates how the prior art methods of determining the positions of frets for an instrument with strings of different scale lengths leads to incorrect fret positions if the strings are not parallel to one another. FIG. 2 shows two strings, the highest frequency, shortest string T–T' (the treble string) and the lowest frequency, longest string B–B' (the bass string), and the other strings have been omitted for clarity. The treble and bass strings have a separation at the nut 11 that is half the separation at the saddle 10. (This separation is defined perpendicular to the centre-line of the fingerboard, as are other separations referred to herein.) The line M–M' indicates the centre line of the fingerboard.

In the fretting scheme of FIG. 2 the twelfth fret is intended to bisect the vibrating length of the strings. The position of the twelfth fret is determined by the straight line joining the twelfth fret position F12 of the reference fret scale F–F' to the point P. The line passes through the mid-point of the centreline M–M', so that the fret is correctly positioned for a string disposed exactly on the centreline M–M' of the fingerboard. However, the midpoint H of the treble string T–T' does not coincide with the $12^{th}$ fret obtained in this way, nor does the midpoint H' of the bass string B–B'. It is apparent that the midpoint of the shorter, treble string, T–T', is biased to the left of the fret (ie, towards the nut 11), and that the midpoint of the longer, bass string, B–B', is biased to the right of the twelfth fret (ie, towards the saddle 10). Thus, it can be seen that frets whose lines are extended to a single point will be positioned correctly only for a string parallel to the position of the reference bar. The positions of the frets will be incorrect for all other strings, and the error will increase as the inclination angle between a string and the reference bar increases.

Many prior art instruments tend to have as little string taper as is practical, in order to maintain an acceptable degree of intonation error but, by doing this, a limit is imposed on the design of the instrument.

STATEMENT OF THE INVENTION

A first aspect of the present invention provides a method of determining the position for a fret on a fingerboard for a stringed instrument having strings of different scale lengths, the method comprising the step of interpolating between, or extrapolating from, a fret position on a first fret scale and a corresponding fret position on a second fret scale. The fret position is therefore derived from two reference fret scales rather than from a single reference fret scale as in the prior art, and this enables the position of the frets to be determined more accurately, for all strings of the instrument.

A second aspect of the present invention provides a method of manufacturing a fingerboard for a stringed instrument comprising the steps of: determining the position of one or more frets by the above; and marking the fingerboard along the or each determined fret position.

A third aspect of the present invention provides a fingerboard manufactured by the above method.

A fourth aspect of the present invention provides a method of manufacturing a jig for marking fret positions on fingerboard for a stringed instrument, the method comprising the steps of: determining the position of one or more frets by a method as defined above; and defining a guide on the jig along the or each determined fret position.

A fifth aspect of the present invention provides a jig manufactured by the above method.

A sixth aspect of the present invention provides a stringed musical instrument comprising a fingerboard of the invention.

BRIEF DESCRIPTION OF THE DRAWINGS

Preferred embodiments of the present invention will now be described by way of illustrative example with reference to the accompanying figures in which:

FIG. 1(*b*) is a schematic view of a prior art fret layout for an instrument with parallel strings of different scale lengths;

FIG. 7(*b*) is a top view of a neck produced from the fingerboard of FIG. 6;

FIG. 9(*b*) is a schematic illustration of a step of setting up the embodiment of FIG. 9(*a*)

DETAILED DESCRIPTION OF THE PREFERRED EMBODIMENTS

Figure 3:
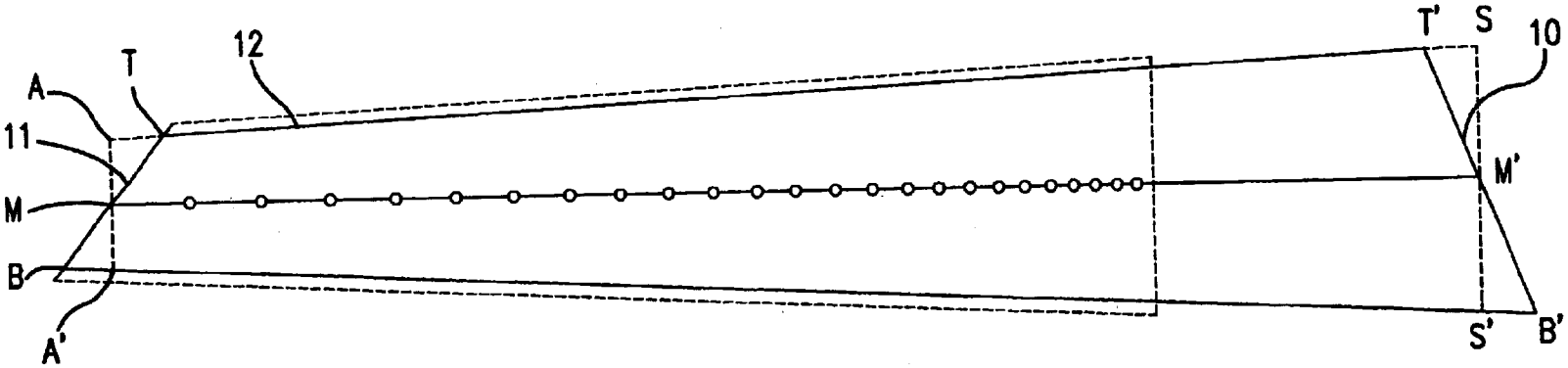
FIG. 3 is a diagram illustrating the measurement points for the nut spacing and saddle spacing, for the present invention.

FIG. 3 illustrates the notation used in the description of the invention. FIG. 3 shows only the shortest string T–T' (the treble string) and the longest string B–B' (the bass string). Other strings have been omitted for clarity, as have the portions of the bass and treble strings that extend beyond the saddle 10 and the nut 11.

The "mid scale" is that length M–M' which is half way between the vibrating length of the treble string T–T' and the vibrating length of the bass string B–B', and represents the centreline of the fingerboard. The "nut spacing" is defined as the distance A–A' between the treble string T–T' and the bass string B–B', measured perpendicular to the centreline at the nut end, M, of the mid scale M–M'. Similarly, the "saddle spacing" S–S' is the distance between the treble string T–T' and the bass string B–B', measured perpendicular to the centreline at the saddle end M' of the mid-scale. In FIG. 3, the line of the treble string T–T' is extended in broken lines to intersect with the spacing measurement lines A–A', S–S'. The outer broken line in FIG. 3 shows the nominal position of that part of the fingerboard on which the frets are to be marked, and the remaining parts of the fingerboard have been omitted for clarity.

The "scale difference" is the difference between the scale length of the treble string T–T' and the scale length of the bass string B–B'. Finally, the "spacing difference" is the difference between the spacing A–A' at the nut and the spacing S–S' at the saddle.

Figure 4:
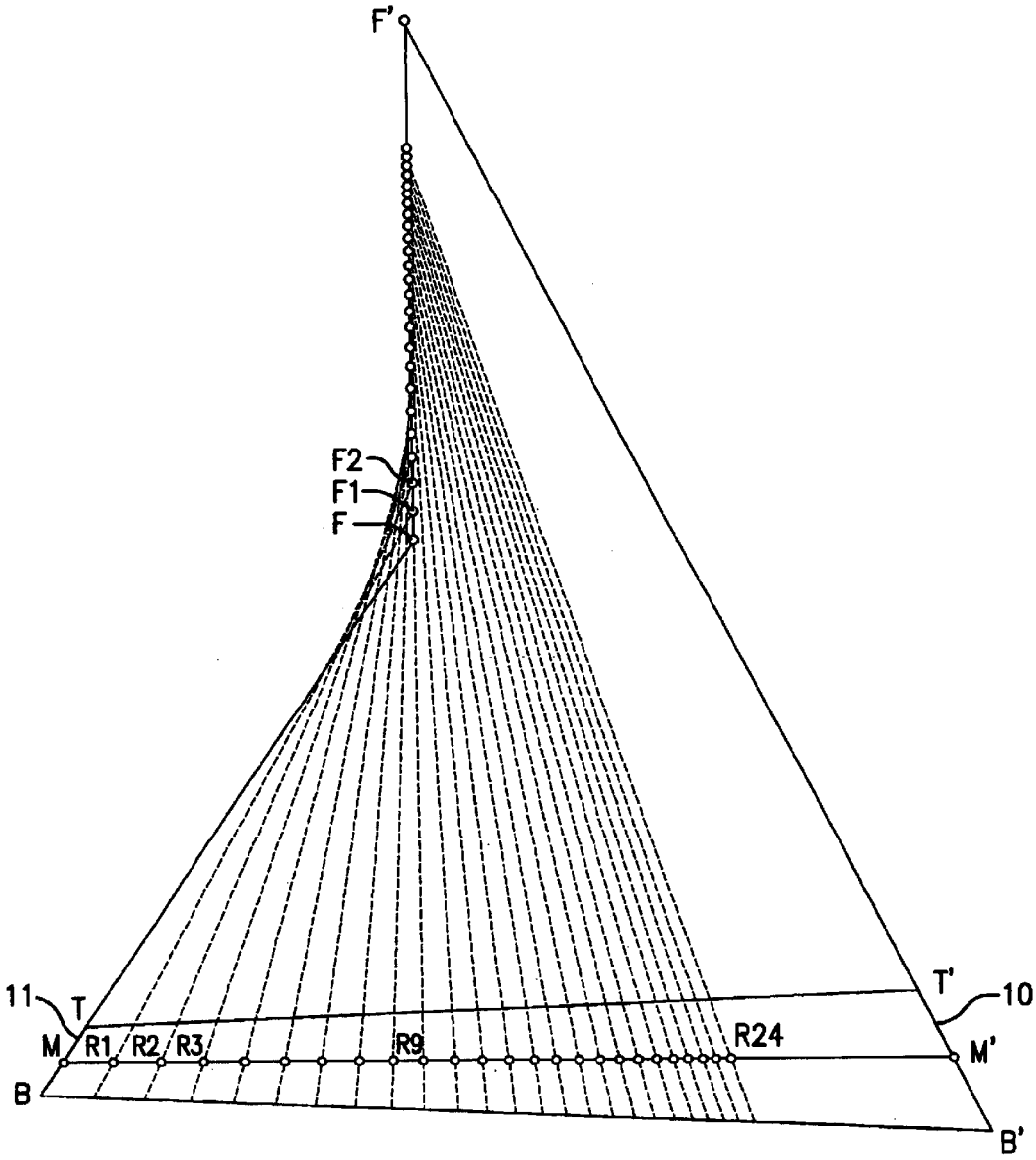
FIG. 4 is a schematic view of fret lines and reference fret scales for a first embodiment of the invention.

FIG. 4 illustrates a first embodiment of the invention, in which two reference fret scales, having different scale lengths, are used to determine the positions of a fret. In this embodiment, a first reference fret scale having frets at positions R1, R2 etc. is defined substantially coincident with the centreline M–M' of the fingerboard, with its zero fret position R0 coincident with the nut end M of the centreline. The first reference fret scale may be defined using a suitable template. A second reference fret scale F–F' having frets at positions F1, F2 etc. is defined substantially perpendicular to the centreline M–M' of the fingerboard, on the treble side of the fingerboard. The position of a fret is determined by interpolating between the position of a fret on the first reference fret scale and the position of the corresponding fret on the second reference fret scale, by projecting a straight line between the position of a fret on the first reference fret scale and the position of the corresponding fret on the second reference fret scale. Thus, the position of the first fret on the fingerboard is defined by a straight line that passes through both the first fret position RI of the first reference fret scale and the first fret position F1 of the second reference fret scale F–F'. The position of the first fret that is determined in this way may be marked on the fingerboard in any conventional way.

In the embodiment of FIG. 4, the $9^{th}$ fret of the fingerboard is desired to be perpendicular to the centreline of the fingerboard. The second reference fret scale F–F' is therefore defined along the extension of the $9^{th}$ fret.

The point F is the point of the second reference fret scale that corresponds to the position of the zero fret on the second reference fret scale. An extension of the nut 11 would pass through the point F since, as noted above, the nut 11 can be considered as a zero fret. The perpendicular distance between the centre line M–M' and the point F is equal to the nut spacing multiplied by the mid-scale divided by the scale difference.

The point F' is the point of the second reference fret scale that corresponds to the saddle 10. The perpendicular distance between the centre line M–M' and the point F' is equal to the saddle spacing S–S' multiplied by the mid-scale divided by the scale difference. An extension of the saddle 10 would pass through the point F'.

The distance between the point F and the point F' is the first distance subtracted from the second distance, and so is equal to the mid-scale multiplied by the spacing difference divided by the scale difference. This distance is the scale length of the second reference fret scale F–F'. That is, the scale length of the second reference fret scale F–F' is given by the following equation:

$$\text{scale length of second reference fret scale} = \frac{\text{mid scale} \times \text{spacing difference}}{\text{scale difference}} \quad (1)$$

The second reference fret scale F–F' is positioned along the extension of the $9^{th}$ fret in FIG. 4, since the $9^{th}$ fret is desired to be perpendicular to the centreline M–M' in FIG. 4.

This embodiment of the invention is not limited to having the second reference fret scale F–F' positioned along the extension of the $9^{th}$ fret. If another of the frets is desired to be perpendicular to the centre-line of the fingerboard, the second reference fret scale F–F' is positioned in line with this fret, perpendicular to the centre-line.

Indeed, the second reference fret scale may be placed at any required point along the fingerboard, and is not limited to being coincident with an extension of a perpendicular fret. It is, however, important that the perpendicular distance between the centre line M–M' of the fingerboard and the point F is equal to the nut spacing multiplied by the mid-scale divided by the scale difference.

Figure 5:
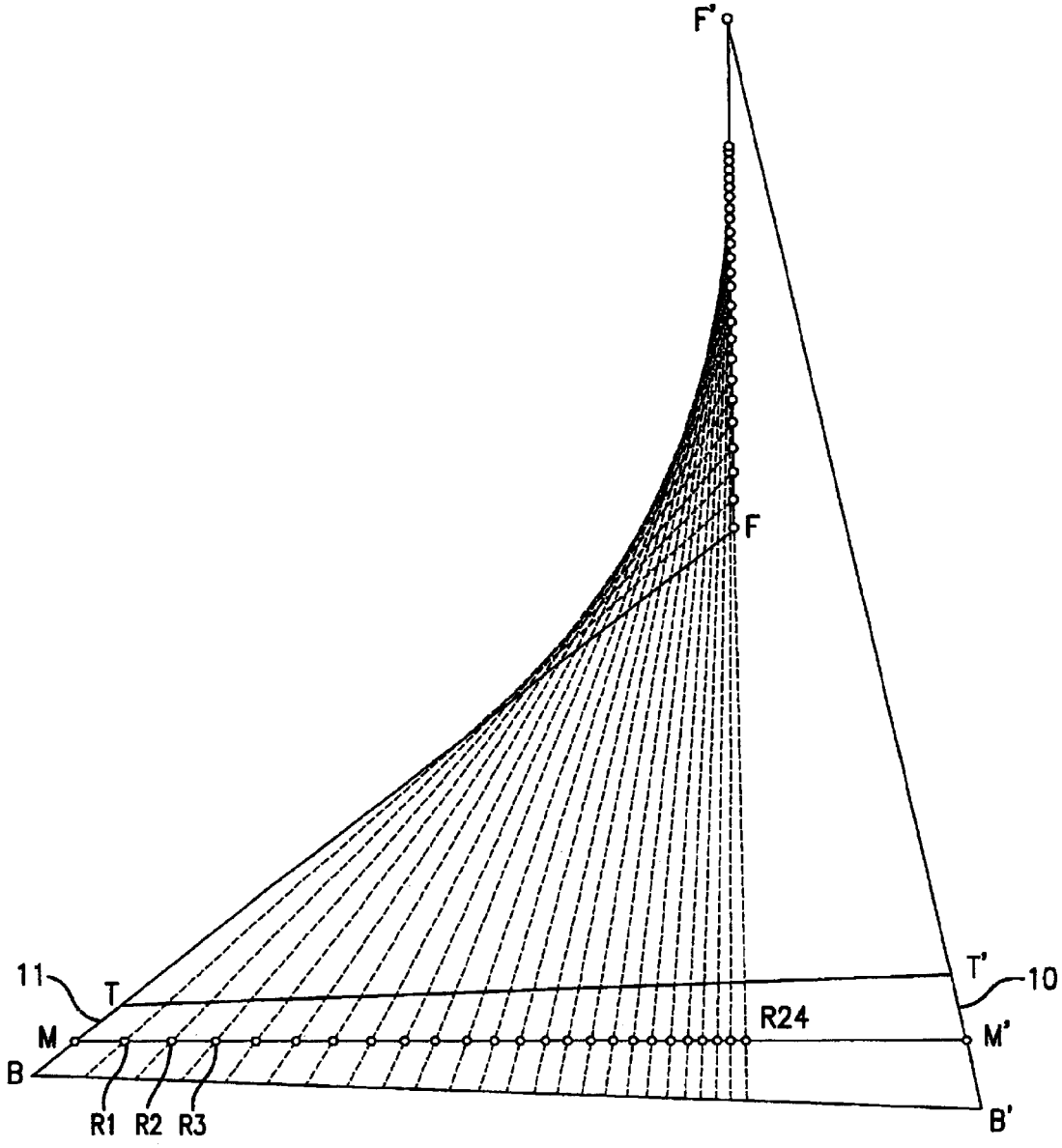
FIG. 5 is a schematic view of fret lines and reference fret scales for a modification of the embodiment FIG. 4.

FIG. 5 shows a modification of the embodiment in FIG. 4 in which the second reference fret scale is aligned with the $24^{th}$ fret. The lengths and taper of the bass and treble strings is the same in FIG. 5 as in FIG. 4, so that the perpendicular distance between the two reference fret scales is the same in FIG. 5 as in FIG. 4. In both FIG. 4 and FIG. 5, the line of the nut 11, or zero fret, defines one end of each reference fret scale, and the line of the saddle 10 defines the other end of each reference fret scale.

An example of the improvement offered by this invention over the prior art will now be given.

Figure 1A:
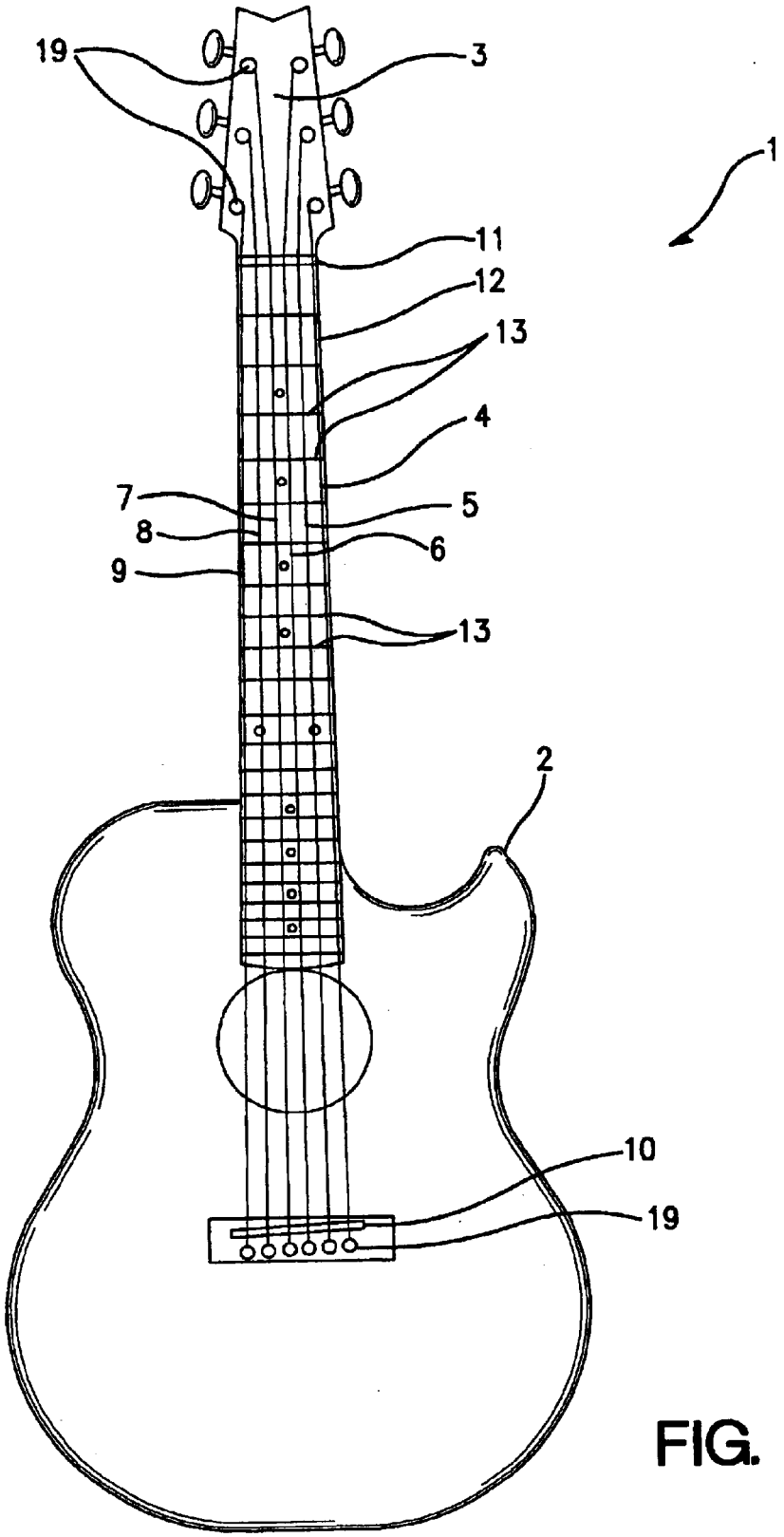
FIG. 1(*a*) is a schematic view of a conventional acoustic guitar.
Figure 2:
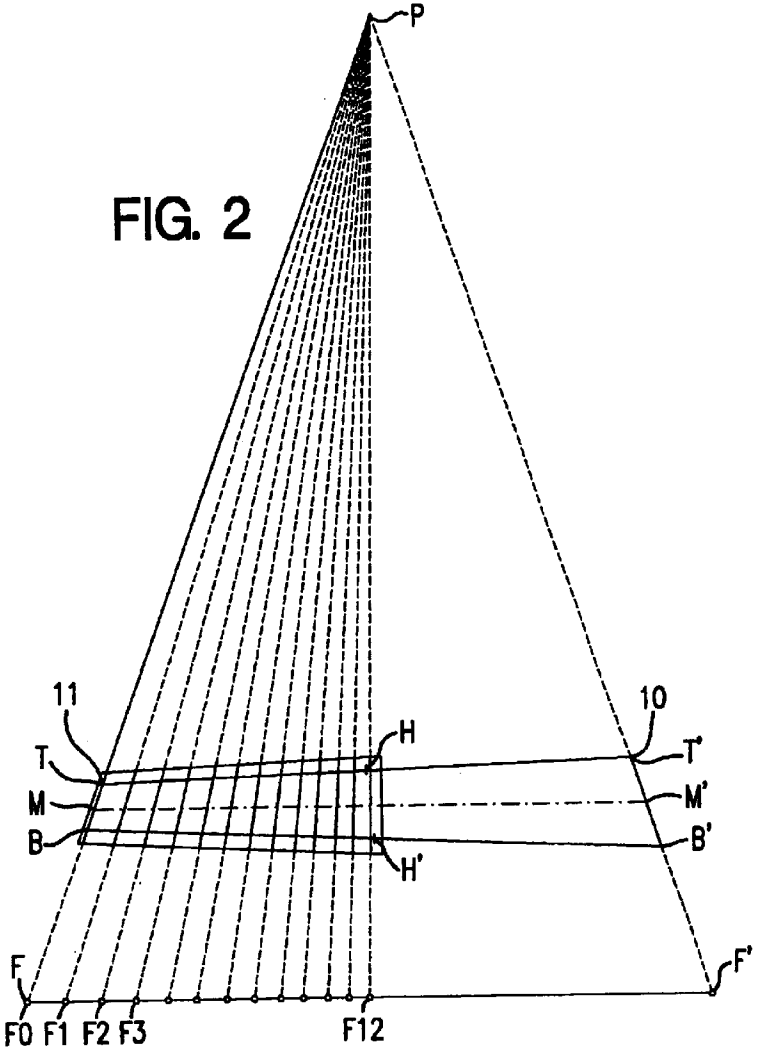
FIG. 2 is a schematic view of a prior art fret layout for an instrument with non-parallel strings of different scale lengths, illustrating fretting inaccuracy.
Figure 1B:
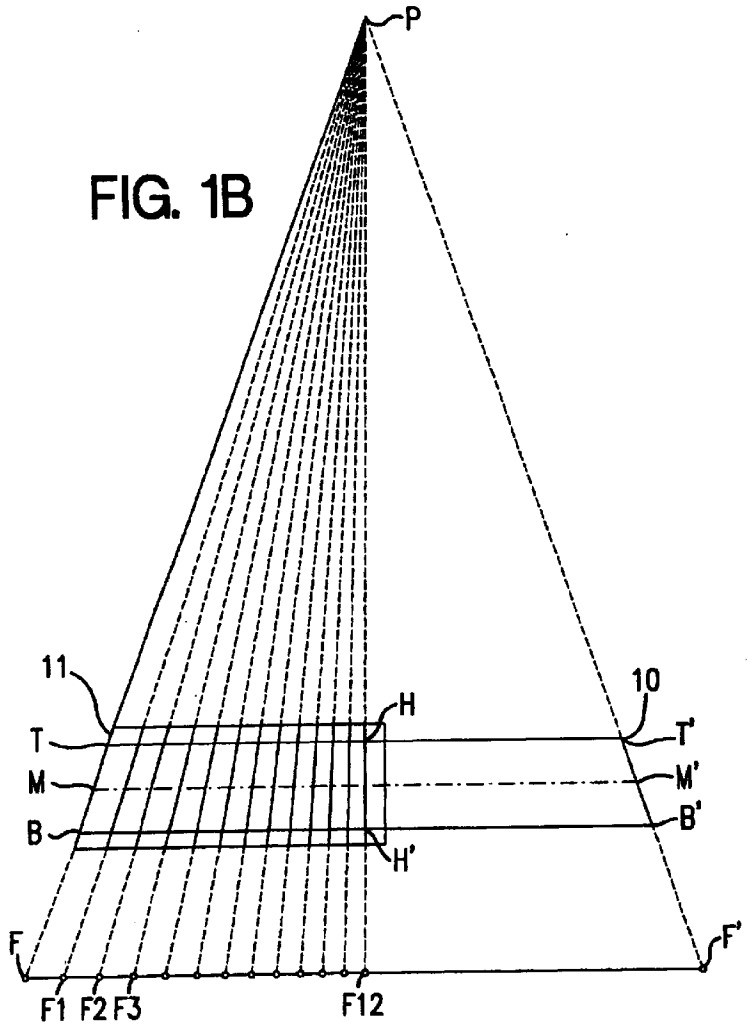

Consider a bass guitar of the prior art as represented by FIG. 2, which has a 2:1 string taper with a 100 mm spacing between the bass string and the treble string at the saddle and a 50 mm spacing between the bass string and the treble string at the nut. It will be assumed that the $12^{th}$ fret is perpendicular to the centre line M–M', and that the fret lines extend to a point of convergence according to the teaching of U.S. Pat. No. 4,852,450. The point of convergence P is assumed to be 1000 mm from the centre line of the fingerboard. A mid scale reference bar of 890 mm produces a nominal treble string vibrating length of 851 mm, and a nominal bass string vibrating length of 923 mm. Using a fret scale system requiring the $12^{th}$ fret to bisect the centreline of the fingerboard, the intersection H of the treble string with the $12^{th}$ fret is found to be higher in pitch, 5.36 mm from the true bisector of the treble string. The intersection of the bass string H' with the $12^{th}$ fret is found to be lower in pitch, 5.77 mm from the true bisector of the bass string. This example reveals an error of 0.63% for the outer strings around the $12^{th}$ fret, while a string coincident with the centre line will show no error. On the treble string, this error equates to musical pitch of no less than $\frac{1}{5}^{th}$ of a semitone. The degree of error will vary, being more evident on the treble string's lower frets, and the bass string's higher frets, where the angle between the string and the fret is more acute.

Consider, however, defining the fret positions using a method as described with reference to FIGS. 4 and 5 above, for a bass guitar having the same taper between the bass and treble strings of 50 mm at the nut to 100 mm at the saddle, and having a treble string 851 mm long and a bass string 923 mm long. The fingerboard requires a first reference fret scale, coincident with the centre line, having a scale length of 887 mm scale length, and a second reference fret scale with a scale length of 616 mm. The second reference fret scale is disposed so that its zero fret point F is 616 mm from the centre line, and is aligned with the line of the $12^{th}$ fret. The intersection of each outer string with the $12^{th}$ fret coincides with the true bisector of each string. A string on the centre line, however, is found to be very slightly higher in pitch, being 0.28 mm from its true bisector. This is the maximum error for this example, and is an error of only 0.03%, equating to a musical pitch of $\frac{1}{100}^{th}$ of a semitone. Thus, the method described with reference to FIGS. 4 and 5 enables fret positions to be defined with much greater accuracy than the prior art methods.

The method of FIGS. 4 and 5 is particularly suitable for a short fingerboard, such as a fingerboard for a mandolin or guitar. In the case of larger fingerboards, such as for a bass instrument, the method may require a work area of one square metre or more, owing to the distance between the two reference fret scales and their overall length. There may therefore be practical problems in applying the method to a large fingerboard. Also, the need to position a reference fret scale on the fingerboard's centre line can cause problems when aligning a saw guide to mark or slot the fingerboard. It may therefore be more convenient in practice to use the method of FIGS. 4 and 5 to make a jig or template for the frets, rather than to mark fret positions directly on a fingerboard.

It will be seen from equation (1) that multiplying both the spacing difference and the scale difference by the same factor x will not change the scale length of the second reference fret scale required for a given mid scale. For example, in the example of a fingerboard having a treble string of scale length 600 mm and a bass string of scale length 700 mm, the scale length of the first reference fret scale disposed on the centre-line of the fingerboard will be 650 mm. If the spacing between the treble string and the bass string decreases from 60 mm at the saddle to 40 mm at the nut, so giving a spacing difference of 20 mm, equation (1) shows that the required scale length of the second reference fret scale is:

$$\frac{650 \times 20}{100} = 130 \text{ mm}$$

If both the spacing difference and the scale difference are multiplied by the factor x=2, then equation (1) shows that the required scale length of the second reference fret scale would be unaltered:

$$\frac{650 \times 40}{200} = 130 \text{ mm}$$

This shows that the arrangement of reference fret scales required to define fret positions for a fingerboard with a treble string of scale length 600 mm and a bass string of scale length 700 mm (so having a scale difference of 100 mm) and a spacing difference of 20 mm may be used also to define fret positions for a fingerboard with a treble string of scale length 550 mm and a bass string of scale length 750 mm (so having a scale difference of 200 mm) and a spacing difference of 40 mm. It will be apparent from this that the fret positions for the fingerboard with a treble string of scale length 600 mm, a bass string of scale length 700 mm and a spacing difference of 20 mm could alternatively be defined by a pair of reference fret scales whose scale lengths and positions correspond to the treble and bass strings of the fingerboard with a treble string of scale length 550 mm, a bass string of scale length 750 mm and a spacing difference of 40 mm. Indeed since the factor x is not limited to x=2, it is in general true that the fret positions for a fingerboard with a given scale difference and spacing difference could be defined by a pair of reference fret scales whose scale lengths and positions correspond to the treble and bass strings of the fingerboard having a scale difference and spacing difference that has been multiplied by a factor x. This will be described below with reference to FIG. 6.

Figure 6:
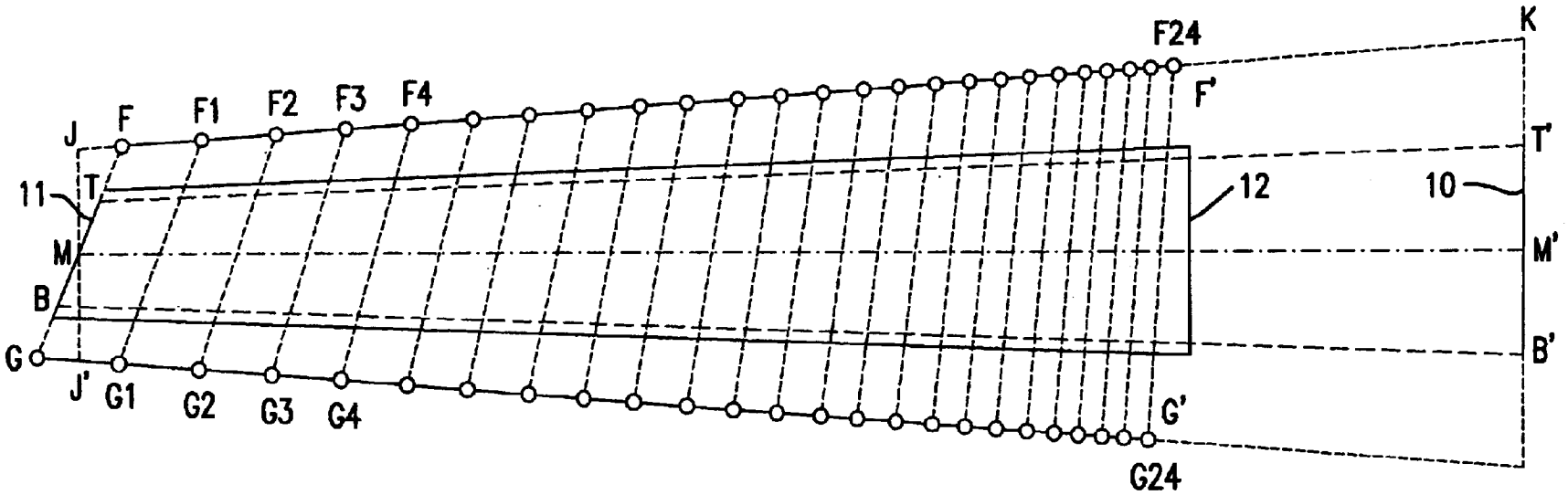
FIG. 6 is a schematic view of fret lines and reference fret scales for a second embodiment of the invention.

FIG. 6 illustrates another embodiment of the invention, which does not require a reference fret scale perpendicular to the fingerboard. This embodiment is therefore more practical for use with a large fingerboard, while retaining the accuracy of the previous embodiment. This embodiment is of use also when aligning the type of frets which are glued to a fingerboard. Initially the first and second reference fret scale are placed in their correct positions for a particular fingerboard it is desired to manufacture. Overlength frets are then clamped, or secured in any convenient way, to the appropriate fret positions on the first and second reference fret scales, and glue is then applied to the surface of each fret. Next, a fingerboard blank is correctly positioned relative to the reference fret scales, and is then brought against the frets so as to adhere the frets to the fingerboard blank. Once the glue has cured the portions of the frets that protrude from the fingerboard can be trimmed. This allows all frets to be glued to the fingerboard blank in one action, and also enables the step of marking the fret positions on the fingerboard blank to be eliminated.

The method of FIG. 6 uses two reference fret scales, one disposed on each side of the fingerboard that is to be provided with frets. FIG. 6 shows an arrangement in which the saddle 10 is chosen to be perpendicular to the centreline of the fingerboard, although the invention is not limited to this. FIG. 6 shows only the treble string T–T' and the bass string B–B', and other strings are omitted for clarity. The extensions of the treble string and bass string beyond the nut and saddle 10 are also omitted from FIG. 6. The line M–M' represent the centreline of the fingerboard. The solid line represents the perimeter of the part of the fingerboard 12 on which the frets are to be defined.

The outer lines F–F' and G–G' represent the reference fret scales. Each reference fret scale is provided with 24 fret positions F1, F2, . . . F24 and G1, G2, . . . G24. In the embodiment of FIG. 6 the reference fret scales end at their highest fret position, so that the end F' of the first reference fret is coincident with its $24^{th}$ fret position F24 and the end G' of the second reference fret is coincident with its $24^{th}$ fret position G24. This is advantageous where the method is used to define fret positions for a large fingerboard, although in principle the reference fret scales could extend beyond their highest fret position. The line of the saddle 10 would intersect the reference fret scales at the points K and K' if the reference fret scales were long enough.

The other ends F, G of the reference fret scales are coincident with the zero fret (nut) position. This end F,G of each reference fret scale is aligned along an extension of the nut 11—that is, the nut 11 lies on the line F–G. A fret position on the fingerboard is defined simply interpolating between the position of a fret on the first reference fret scale F–F' and the position of the corresponding fret on the second reference fret scale G–G'. For example, the first fret position on the fingerboard is defined by the straight line joining the first fret position F1 on the first reference fret scale F–F' to the first fret position G1 on the second reference fret scale G–G'.

The separation at the nut 11 of the reference fret scales, measured perpendicular to the centreline M–M', is chosen to be a multiple—x—of the separation at the nut, again measured perpendicular to the centreline M–M' of the bass and treble strings. That is, the distance J–J' in FIG. 6 is x times as great as the distance A–A' in FIG. 3. The separation at the saddle 10 of the reference fret scales, measured perpendicular to the centreline M–M', is chosen to be the same multiple of the separation at the saddle, again measured perpendicular to the centreline M–M' of the bass and treble strings. That is, the distance K–K' in FIG. 6 is x times as great as the distance S–S' in FIG. 3. In the description below of the method of FIG. 6 it will be assumed that x=2, but x is not limited to 2.

In the method of FIG. 6, the values for spacing between the treble string and the bass string at the nut and at the saddle are measured perpendicular to the centre line, and are multiplied by x—i.e., doubled for the case x=2—to give the lengths J–J' and K–K'. The distance along the centreline M–M' from the nut line to the saddle line is half way between the desired scale length of the treble string and the desired scale length of the bass string. The reference fret scales are preferably an equal distance from the centre-line (measured perpendicularly to the centre-line) for any given point on the centreline.

Once the lengths J–J' and K–K' have been calculated, the lines J–K and J'–K' can be defined and the reference fret scales are aligned along these lines—the first reference fret scale F–F' along the line J–K, and the second reference fret scale G–G' along the line J'–K'. Each reference fret scale may then be translated along the respective lines until it is correctly positioned. In the example of FIG. 6, the reference fret scales can be correctly aligned by aligning the zero fret positions F, G with the extension of the nut line TB.

In another example of aligning the reference fret scales, if a fret mark on the fingerboard is desired to be perpendicular to the centre line M–M' then each reference fret scale would be translated along the respective line J–K, J'–K' until the corresponding fret-mark of each reference fret scale could be joined by a line perpendicular to the centre-line M–M' of the fingerboard.

The length and hence scale of each reference fret scale is determined by the desired scale lengths of the outer strings. Since the perpendicular spacing J–J', K–K' between the two reference fret scales string at the nut and at the saddle are a factor of x greater than the perpendicular spacing T–B, T'–B' between the bass and treble string at the nut and at the saddle, the scale difference between the bass and treble strings is also multiplied by the factor x to establish the difference between the scale lengths of the two reference bars.

As explained above, the position of the reference fret scales in FIG. 6 correspond to the position of the treble and bass strings for a fingerboard that has a scale difference and a spacing difference that are each x times greater than the fingerboard for which the fret positions are to be defined.

As an example, consider marking the fret positions for a fingerboard for an instrument having a 620 millimetre treble string T–T', and a 640 millimetre bass string, B–B'. In the case x=2, the method of FIG. 6 would require the reference bar F–F' on the treble side to have a 610 millimetre scale length, and would require the reference bar G–G' on the bass side to have a 650 millimetre scale length. (The scale lengths of the reference bars are the lengths F–K and G–K'.) This retains the mid-scale, M–M', at 630 millimetres. If the desired perpendicular spacing between the treble string and the bass string is to be 45 millimetres at the nut and 65 millimetres at the saddle, then the reference bars should be spaced apart (measured perpendicular to the mid scale) by 90 millimetres at the nut and by 130 millimetres at the saddle. That is, in this example J–J' should be 90 mm and K–K' should be 130 mm.

The embodiment of FIG. 6 has been described above with reference to the case x=2. However the embodiment is not limited to x=2 and x may take other values. In principle x may take any value, but in practice if $x \leqq 1$ the two reference fret scales would overlie the fingerboard blank, and this would complicate marking the fret positions on the fingerboard blank. The method described above in which glue is applied to overlength frets that are secured to the reference fret scales cannot be used if the reference fret scales overlie the fingerboard blank. If the reference fret scales overlie the fingerboard blank it would be necessary to mark the positions of the frets on the fingerboard blank, remove the reference fret scales, and then use the markings as a guide to attach the frets to, or cut the frets into, the fingerboard blank. It is therefore preferred that the reference fret scales do not overlie the fingerboard blank, since this enables the frets to be attached to, or cut into, the fingerboard blank while the reference fret scales are still in position. Thus, x is preferably greater than one.

Conversely, as x increases the space required by the embodiment also increases so that use of high values of x is also undesirable in practice. It has been found that choosing x to be approximately 2, for example $1.5<x<2.5$, allows the reference fret scales to be kept clear from the fingerboard blank without requiring excessive space.

In the embodiment of FIG. 6, the two reference fret scales are not parallel to the centre line of the fingerboard, but their separation increases from the nut to the saddle. In a modified embodiment, the reference fret scales are positioned so that they are each parallel to the centre-line of the fingerboard. Arranging the reference fret scales parallel to the centre-line is easier to set up and, although less accurate than the method of FIG. 6, will produce acceptable results if the string taper is low.

Figure 7A:
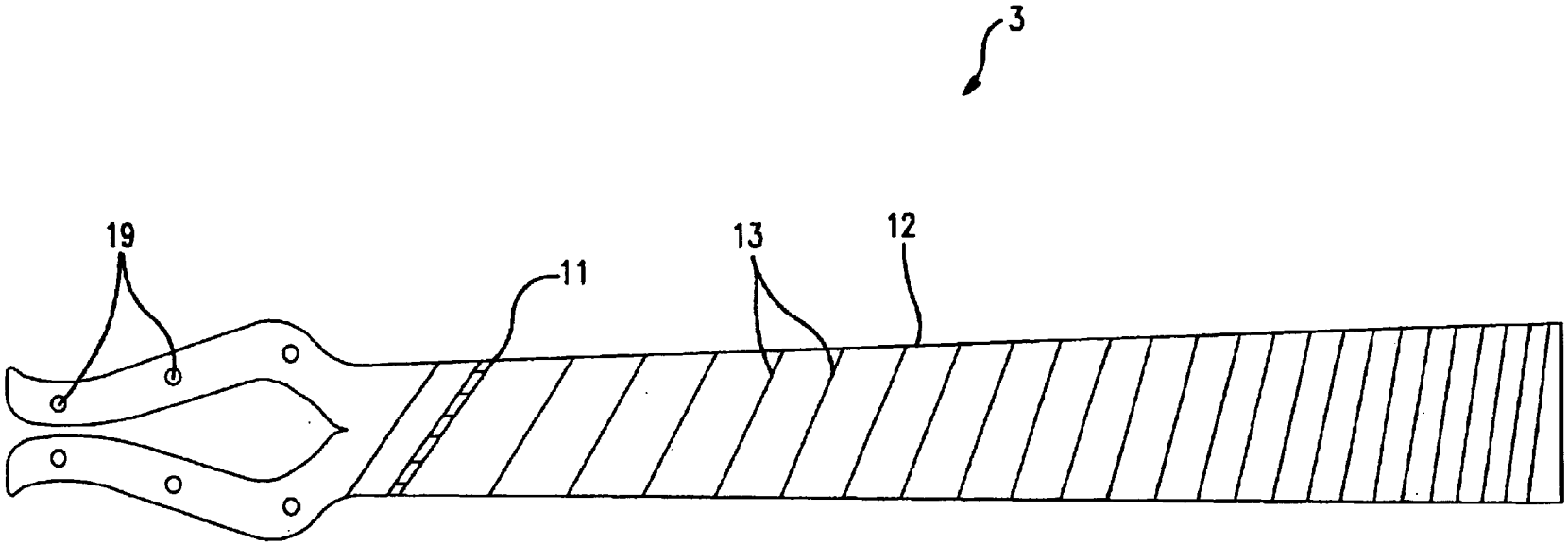
FIG. 7(*a*) is a top view of a neck of a conventional fingerboard.
Figure 7B:
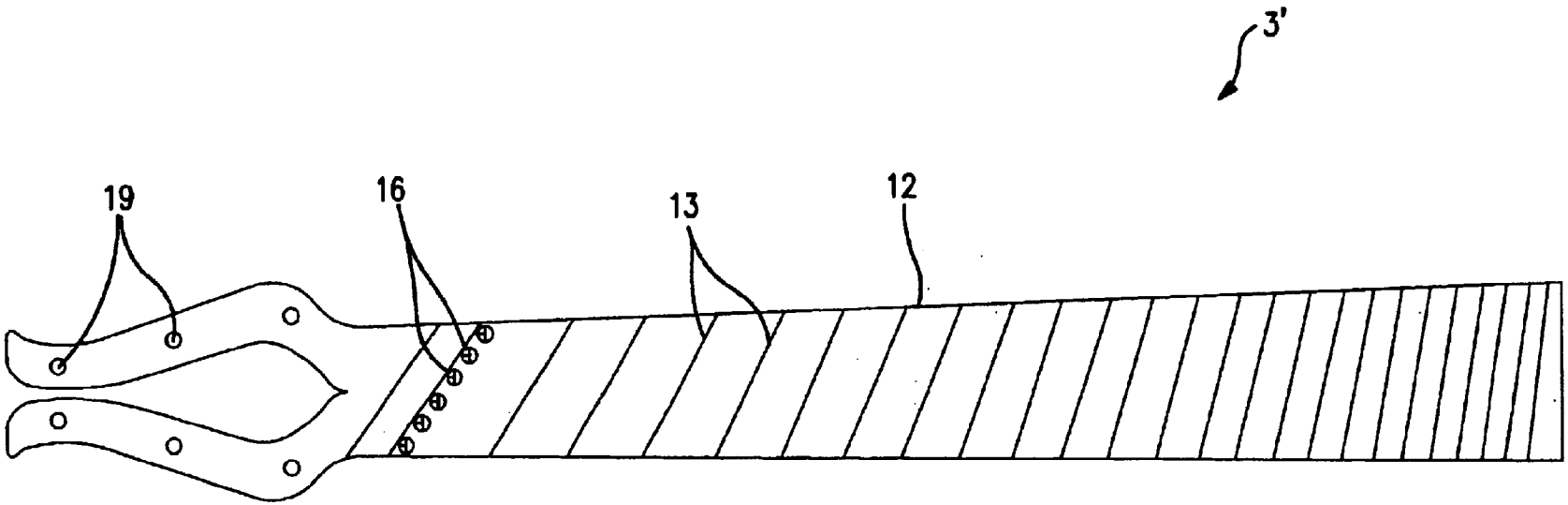
Figure 8A:
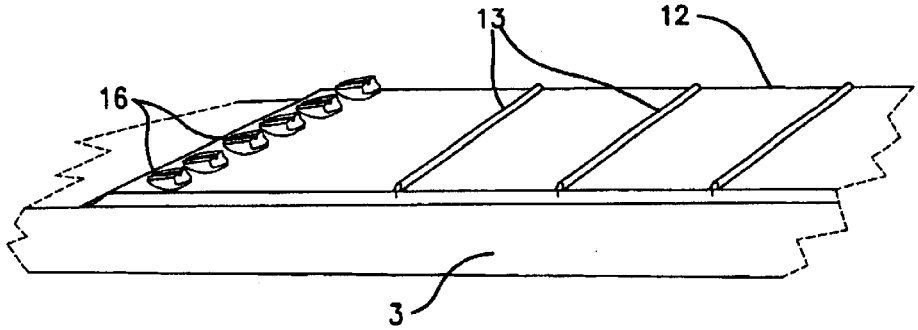
FIGS. 8(*a*) to 8(*e*) illustrate a nut-post of the present invention.
Figure 8B:
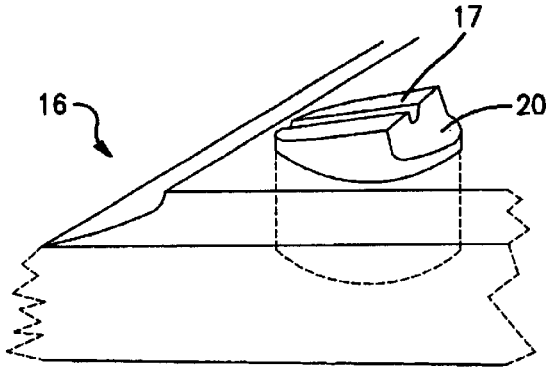
Figure 8C:
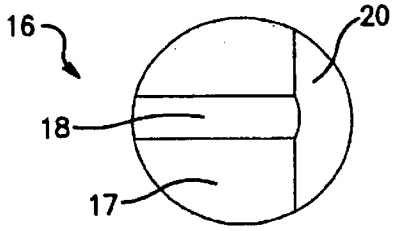
Figure 8D:
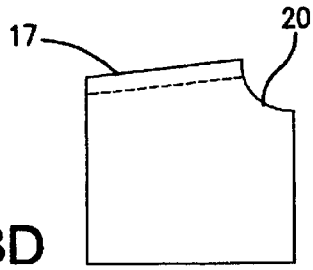
Figure 8E:
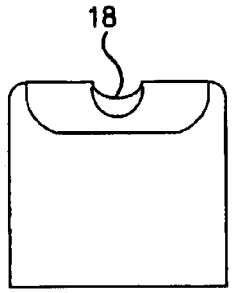

FIG. 7(*a*) is a plan view of an instrument neck 3, which has a fingerboard 12 in which the positions of the frets 13 are defined by the method of FIG. 6. This can be built new into an instrument or, in the case of an instrument that has a detachable neck (for example a bolt-on neck), can be used to replace a pre-existing neck.

FIG. 7(*b*) is a plan view of another instrument neck 3', which has a fingerboard 12 in which the positions of the frets 13 are defined by the method of FIG. 6. This can be built new into an instrument or, in the case of an instrument that has a detachable neck (for example a bolt-on neck), can be used to replace a pre-existing neck. The neck 3' of FIG. 7(*b*) differs from the neck 3 of FIG. 7(*a*) in that a plurality of nut posts 16 are used in the neck of FIG. 7(*b*), in place of a conventional nut. These are described below with reference to FIGS. 8(*a*) to 8(*c*). The neck 3 shown in FIG. 7(*a*), in contrast, has a conventional nut 11.

A further embodiment of a method of determining fret positions will now be described. For certain fretting configurations of a fingerboard, it may be possible to simplify the equipment required to effect the method of FIGS. 4 and 5, and improve access to the working area, thereby improving the production yield. This arrangement may comprise the general layout of the detailed description, and based on the same calculated dimensions, with the following alterations, as illustrated in FIG. 9(*a*).

Figure 9A:
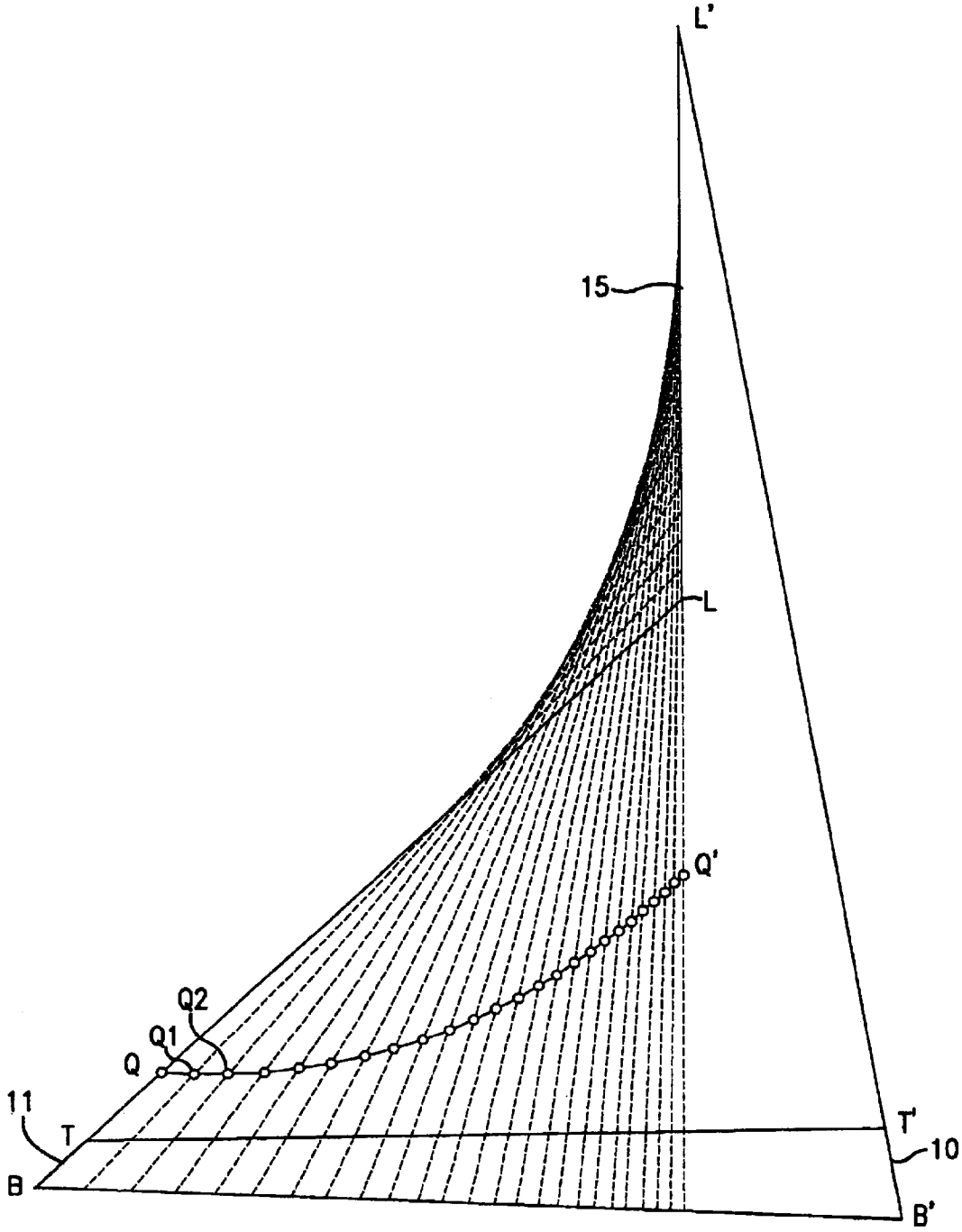
FIG. 9(*a*) is a schematic illustration of fret lines and reference bars for a third embodiment of the invention.
Figure 9B:
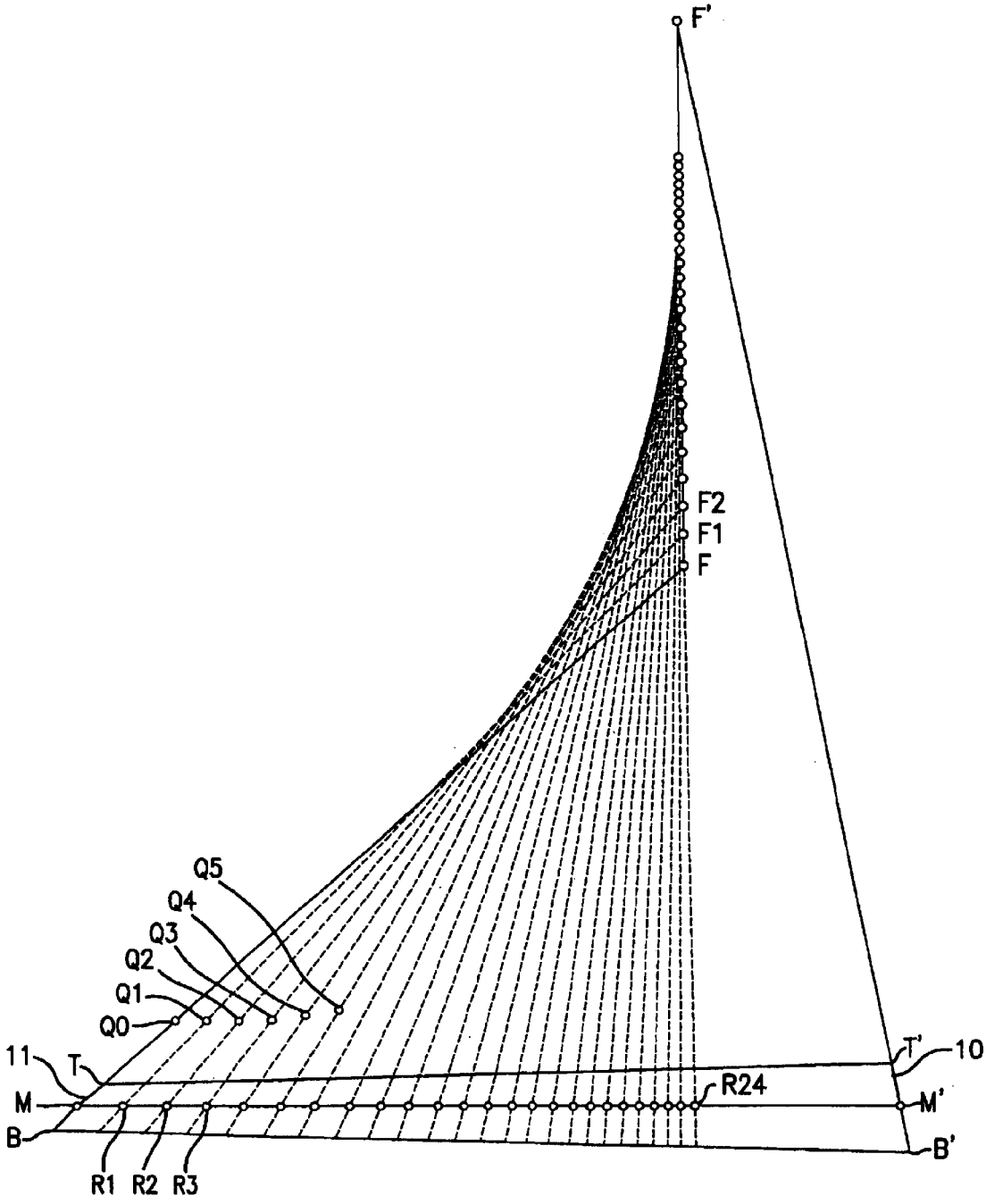

In the method of FIG. 9(*a*), the perpendicular reference fret scale used in the embodiments of FIGS. 4 and 5 is replaced with a slot or channel 15 of at least the same length as the perpendicular reference fret scale. One end of the slot or channel is denoted by L and the other end is denoted by L'. The slot or channel 15 is aligned perpendicular to the centreline of the fingerboard, for example coincident with the extension of a fret that is desired to be perpendicular to the centreline of the fingerboard.

One pin of a saw-guide locates in the perpendicular slot or channel 15, and is able to precisely slide in the direction of the slot or channel only.

The reference fret scale disposed on the centre-line of the fingerboard in the embodiments of FIGS. 4 and 5 is replaced by a reference fret scale Q–Q' positioned on the treble string side of the fingerboard, at an angle, depending on the dimensional requirements, to the centre-line of the fingerboard. The reference fret scale Q–Q' is provided with a plurality of locations Q0, Q1, Q2 etc for another saw guide pin (in FIG. 9(*a*) the position of the location Q0 is coincident with the end Q of the reference fret scale, but this need not be the case). Another saw-guide pin is positioned at one of the locations Q0, Q1, Q2 . . . of the reference fret scale Q–Q'. It is a condition that the saw-guide pin in the reference fret scale Q–Q' is at a fixed distance from the pin located in the perpendicular slot or channel. This can be achieved by, for example, connecting the two saw guide pins to opposite ends of a rod of an appropriate length.

The reference fret scale Q–Q' is placed with its nut end Q along the extension of the nut BT, on the treble side of the fingerboard. One saw guide is placed in the reference fret at the fret position Q0, and the other saw guide is placed in the slot 15. A saw is positioned with its blade in both saw guide, and is used to mark the zeroth fret on the fingerboard. The saw guide in the reference fret scale is then moved from Q0 to Q1, and the other saw guide is moved along the slot 15 so as to keep the distance between the two saw guides constant. The first fret can then be marked on the fingerboard. This process is then repeated to mark the other frets on the fingerboard.

It is a further condition that, as one saw guide is located at each fret position on the reference fret scale Q–Q' in turn, the sliding saw guide located in the channel 15 comes to rest at positions in the channel which closely resemble the fret positions F, F1, F2 . . . of the perpendicular reference fret scale of FIGS. 4 and 5. This is ensured by suitably positioning the fret positions Q0, Q1, Q2 . . . of the reference fret scale Q–Q'.

The fret positions Q0, Q1, Q2 . . . along the reference fret scale Q–Q' may be determined in the following way. Initially a reference fret scale such as the reference fret scale F–F' of FIG. 4 or 5 is disposed perpendicular to the centreline of the fingerboard, with the perpendicular distance between the zeroth fret position F and the centreline of the fingerboard being equal to the nut spacing multiplied by the mid-scale divided by the scale difference. A second reference fret scale having fret positions R1, R2 . . . is defined along the centreline of the fingerboard (or along the intended position of the fingerboard on a suitable working surface), and the lines F–M, F1–R1, F2–R2 etc. shown in FIGS. 4 and 5 are then defined.

The point Q0 is located on the line F–M, and is chosen to be a certain distance from the zeroth fret position F of the perpendicular reference fret. The point Q1 is located on the line F1–R1, and is chosen to be the same distance from the first fret position F1 of the perpendicular reference fret as the point Q is from the zeroth fret position F of the perpendicular reference fret. Similarly, the point Q2 is located on the line F2–R2, and is chosen to be the same distance from the second fret position F2 of the perpendicular reference fret as the point Q0 is from the zeroth fret position F of the perpendicular reference fret. That is the distance Q0–F=the distance Q1–F1=the distance Q2–F2 etc. This is shown in FIG. 9(*b*).

The points Q0, Q1, Q2 etc are then marked on a suitable surface. Once the points Q0, Q1, Q2 etc have marked on a suitable working surface, the perpendicular reference fret is no longer required. It is preferably removed, and replaced by the channel 15.

The points Q0, Q1, Q2 etc may be drilled, so that a saw guide pin can be placed at the points Q0, Q1, Q2 etc. If this is done, a second saw guide pin may be placed in the channel 15, so that a fret may be marked on the fingerboard by a saw blade that is located in both saw guide pins. As noted above, the distance between the two saw guide pins should be constant for each fret.

A fingerboard may now be placed on the working surface, and the fret positions may be marked on the fingerboard using a saw blade located in both saw guide pins.

In the above embodiment of FIG. 9(*a*), one saw guide post is positioned in the reference fret scale Q–Q' and another saw guide post is positioned in the slot 15, and a saw blade is located in the two saw guide posts. The embodiment of FIG. 9(*a*) is not limited to this method of marking the frets, however. The embodiment of FIG. 9(*a*) can be used generally to define the line passing through a position Q0, Q1, Q2 etc on the reference fret scale Q–Q' and the corresponding position in the slot 15, and this line can be marked on a fingerboard by any suitable marking method.

In an alternative embodiment, the positions Q0, Q1, Q2 of the reference fret scale Q–Q' are not drilled to receive a saw guide pin. Instead, the fret scales may be defined using a straight edge that extends from the channel 15 to the fingerboard, by aligning the straight edge with each of the points Q0, Q1, Q2 etc in turn. In this embodiment, it is sufficient to mark the positions Q0, Q1, Q2 on a suitable working surface. The straight edge is preferably provided with a pin or other protrusion that slidingly locates in the channel 15, since this makes it straightforward to ensure that, for each fret, there is a constant distance between the respective point Q0, Q1, Q2 and the respective point in the channel 15.

The distance Q0–F is preferably chosen so that the points Q0, Q1, Q2 etc are as close as is feasible to the intended position of the fingerboard on the working surface, subject to none of the points overlapping the intended fingerboard position.

In this embodiment, the fingerboard blank may be located to one side of all tooling, so that this embodiment lends itself to possible automation of the process. Also, the position of the guide is determined by one pin, providing simpler operation.

For the most accurate application of this embodiment, the holes or marks on the reference fret scale Q–Q' do not conform to a standard fret scale, nor even to a straight line. As shown in FIG. 9, most accurate results are obtained using a curved reference fret scale Q–Q'. Manufacture of the curved reference fret scale Q–Q' may cost more than is practical for low-volume production so, in a modification of the embodiment of FIG. 9(*a*), a standard linear reference fret scale of suitable scale-length is used. This will result in some loss of accuracy in determining the fret positions but, for certain types of fingerboard, the degree of inaccuracy may be considered acceptable when weighed against cost and ease of use.

The process of determining a fret position according to the embodiment of FIG. 9(*a*) may be considered as using a fret position on one fret scale and a corresponding fret position on another fret scale, by extrapolating from a fret position on one fret scale and a corresponding fret position on another fret scale. This is because the position in the channel 15 at which the second saw guide pin, for example, is located when a fret position is determined correspond to one of the fret positions of the perpendicular reference fret scale F–F' of FIGS. 4 and 5.

A further aspect of the invention relates to the provision of means that enables fine adjustment of the length of the strings. Fittings that allow the length of the strings to be adjusted are commonly available, but invariably they allow adjustment only in a direction parallel to the centre line of the instrument. With a fingerboard having frets determined by a method according to the present invention, adjusting the lengths of the strings by moving the saddle along the centre-line of the fingerboard may produce intonation errors on the outer strings. Lengthening these strings with such a fitting will cause a change in the calculated string taper, and a deviation of the string's position relative to the fingerboard; this problem will be particularly noticeable for string tapers exceeding 2:1. Overcoming this problem requires a means of lateral adjustment that enables the correct taper ratio, and hence the correct string position, to be restored or, alternatively, means which provides string length adjustment in line with each string's centre line.

On most conventional stringed instruments, the fingerboard is cut square at the "zero fret" position. A separate part, which is slotted to retain the strings correctly spaced and at the correct height above the fingerboard, is fitted at this end of the fingerboard, and this part is known as the nut. The nut may also be used in conjunction with a zero-fret; in this arrangement, the zero fret determines the height of the strings above the fingerboard while the nut determines the lateral spacing between strings. The nut supports all the strings, and, as with the saddle, the strings are virtually perpendicular to the plane of the nut or saddle which faces the fingerboard. With a fingerboard having fret positions determined according to the present invention, it is possible that the nut angle may deviate substantially from the perpendicular, so that a conventional nut piece does not adequately support each string in its correct position. A zero-fret may also be an inadequate anchor, especially if a vibrating string is able to slide across it.

The present invention accordingly provides a nut post that overcomes these problems. A nut post 16 according to the invention is illustrated in FIGS. 8(*a*) to 8(*e*). FIG. 8(*a*) shows six nut posts disposed on a neck, and FIG. 8(*b*) is an enlarged perspective view of one of the nut posts. FIGS. 8(*c*) to 8(*e*) show, respectively, top, side and end views of a nut post.

As shown in the Figures, the upper face 17 of the nut post is provided with a groove 18 for receiving a string. In use a string is disposed in the groove 18 and is anchored by a suitable anchor post 19 (FIG. 7(*b*)). The face of the nut post that faces along the fingerboard is shaped to present a perpendicular face to each string, provided that the anchor point of each string is maintained on the "nut-line". Each nut post 16 is secured firmly to the neck (for example by insertion into a hole into the neck) and is centred on the nut-line of the fingerboard as shown in FIG. 7(*b*).

A nut post is shown in detail in FIGS. 8(*a*) to 8(*c*). The upper face 17 of the nut post is slanted, relative to the surface of the fingerboard, and the groove 17 for the string is therefore at and angle to the plane of the of the fingerboard, as on a conventional nut. A surface 20 is filed onto the side of the nut-post that faces the fingerboard. Filing the surface 20 deeper will increase the vibrating length of the string, without affecting the taper of the string. This method offers a simple means of fine-tuning the string length, by filing the surface deeply or not so deeply, as required. A suitable diameter for the nut post may be 2–3 times greater than the thickness of the string.

The manufacture of conventional, parallel-fretted fingerboards commonly employs a dedicated machine with a single shaft driving a number of circular blades, corresponding to the number of slots required. Such a machine may slot a fingerboard in a matter of seconds. The production of fingerboards for instruments with strings of differing lengths cannot use such a machine, owing to the non-parallel relationship of the frets or marks.

In principle, the methods of determining the fret positions of the invention can be used to determine the fret positions of an individual fingerboard. In practice, however the methods may be too time-consuming for efficient mass-production purposes, and may thus be reserved for "bespoke" instruments. In order to apply the invention to mass-production, it is possible to use a method of the invention in the fabrication of a fingerboard marking "jig". Once a jig has been prepared it can be used to mark the fret positions on a large number of fingerboards quickly and accurately.

Figure 10:
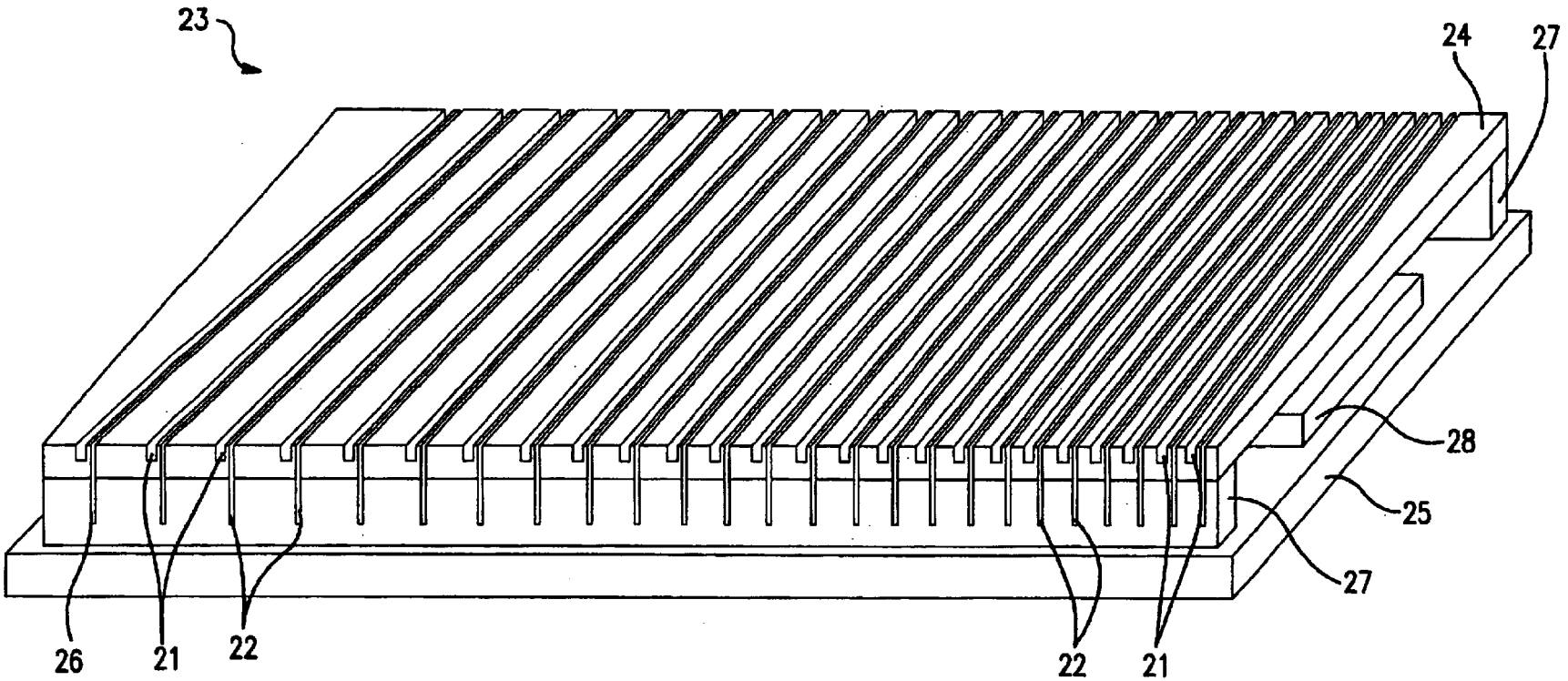
FIG. 10 is a perspective view of a fret-slotting jig.

An example of such a jig 23 is illustrated in FIG. 10. This example is intended to be used with a circular saw tool. The saw tool has a batten secured to the underside of the base-plate, so that the tool is guided by the batten engaging in one of the wide, shallow slots 21 in the top plate 24 of the jig. This ensures that the blade follows the correct path along the deep narrow slots 22 in the top plate 24 of the jig. The deep, narrow slots 22 correspond to the desired positions of the frets, and the locations of the deep, narrow slots were defined by a method of the invention. The fingerboard blank is inserted into the jig, between the top plate 24 and the bottom plate 25. The fingerboard blank is positioned accurately relative to the slots 22 in the top plate of the jig, for example by aligning the blank so that the end deep slot 26 of the jig corresponds to the desired position of the first fret on the fingerboard, and is then secured. A fret can then be marked on the fingerboard blank, by aligning the batten of the circular saw tool in the appropriate wide, shallow slot.

The jig may be fabricated with a cambered top surface, to allow the blade to follow the desired radius of the fingerboard, though a severe camber may be undesirable since it might cause the blade of the saw to misalign with the fingerboard where the slot is at a more acute angle to the centre line. The top plate 24 and bottom plate 25 of the jig are spaced apart by side members 27, and the distance between the top plate 24 and bottom plate 25 is chosen to accommodate the thickest fingerboard blank. The jig is preferably provided with a removable packing member 28, to accommodate fingerboard blanks of a lower thickness.

The embodiments of the invention described with reference to FIGS. 4, 5, 6 and 9(*a*) above are suitable for determining fret positions for a fingerboard for an instrument intended for a right-handed player. A fingerboard for an instrument intended for a left-handed player would be required to be a mirror image of a fingerboard for an instrument intended for a right-handed player, and the embodiments of the invention would need to be adapted accordingly.

What is claimed is:

1. A method of determining the position for a fret on a fingerboard for a stringed instrument having strings of different scale lengths, the method comprising the step of interpolating between, or extrapolating from, a fret position on a first reference fret scale and a corresponding fret position on a second reference fret scale, the second reference fret scale being perpendicular to the centreline of the fingerboard; wherein the scale length of the second reference fret scale is give by:

$$\text{scale length of second reference fret scale} = \frac{\text{mid scale} \times \text{spacing difference}}{\text{scale difference}}. \quad (1)$$

2. A method as claimed in claim 1, wherein the first reference fret scale has a first scale length and the second reference fret scale has a second scale length different from the first scale length.

3. A method as claimed in claim 1, wherein the first reference fret scale is coincident with the centreline of the fingerboard.

4. A method as claimed in claim 1, wherein the first reference fret scale is laterally separated from the centreline of the fingerboard.

5. A method as claimed in claim 4, wherein the first reference fret scale is disposed on the same side of the centre-line of the fingerboard as the second reference fret scale.

6. A method as claimed in claim 4, wherein the first reference fret scale is a non-linear scale.

7. A method of determining the position for a fret on a fingerboard for a stringed instrument having strings of different scale lengths, the method comprising the step of interpolating between, or extrapolating from, a fret position on a first reference fret scale and a corresponding fret position on a second reference fret scale; wherein the first reference fret scale is disposed on one side of the centerline of the fingerboard and the second reference fret scale is disposed on the other side of the centerline of the fingerboard; wherein the spacing between the first and second reference fret scales at the nut and the saddle is x times as great as the spacing between the outermost strings at the nut and the saddle respectively; and wherein the difference between the scale length of the first reference fret scale and the scale length of the second reference fret scale is x times as great as the difference between the scale lengths of the outermost strings at the nut and the saddle.

8. A method as claimed in claim 7, wherein the first and second reference fret scales are disposed parallel to the centre-line of the fingerboard.

9. A method as claimed in claim 7, wherein the separation between the first reference fret scale and the second reference fret scale increases from the nut of the fingerboard towards to saddle of the fingerboard.

10. A method as claimed in claim 7, where x is approximately equal to 2.

11. A method as claimed in claim 7, wherein the first and second reference fret scales are disposed symmetrically about the centre-line of the fingerboard.

12. A method of manufacturing a fingerboard for a stringed instrument comprising the steps of determining the position of at least one fret by a method as defined in claim 1 and marking the fingerboard along the or each determined fret position.

13. A fingerboard manufactured by a method as defined in claim 12.

14. A method of manufacturing a jig for marking fret positions on fingerboard for a stringed instrument, the method comprising the steps of: determining the position of at least one fret by a method as defined in claim 1, and defining a guide on a jig along the or each determined fret position.

15. A method as claimed in claim 14 wherein the step of defining a guide comprises forming a slot along the or each determined fret position.

16. A jig manufactured by a method defined in claim 14.

17. A stringed musical instrument comprising a fingerboard as defined in claim 13.

* * * * *